US009328603B2

(12) United States Patent
Pope

(10) Patent No.: US 9,328,603 B2
(45) Date of Patent: May 3, 2016

(54) METHOD AND APPARATUS FOR PROTECTING DOWNHOLE COMPONENTS FROM SHOCK AND VIBRATION

(71) Applicant: Hunting Energy Services, Inc., Houston, TX (US)

(72) Inventor: Jason Michael Pope, Magnolia, TX (US)

(73) Assignee: Hunting Energy Services, Inc., Houston, TX (US)

( * ) Notice: Subject to any disclaimer, the term of this patent is extended or adjusted under 35 U.S.C. 154(b) by 351 days.

(21) Appl. No.: 14/087,514

(22) Filed: Nov. 22, 2013

(65) Prior Publication Data

US 2015/0129307 A1 May 14, 2015

Related U.S. Application Data

(63) Continuation-in-part of application No. 14/078,003, filed on Nov. 12, 2013, now abandoned.

(51) Int. Cl.

| | |
|---|---|
| ***E21B 47/01*** | (2012.01) |
| ***E21B 12/00*** | (2006.01) |
| ***E21B 17/04*** | (2006.01) |
| ***E21B 17/043*** | (2006.01) |

(52) U.S. Cl.

CPC ..... *E21B 47/01* (2013.01); *E21B 12/00* (2013.01); *E21B 17/043* (2013.01)

(58) Field of Classification Search

CPC ..... E21B 47/01; E21B 47/011; E21B 12/00; E21B 17/043

See application file for complete search history.

(56) References Cited

U.S. PATENT DOCUMENTS

| | | | | |
|---|---|---|---|---|
| 2,813,697 | A | 11/1957 | Swart | |
| 3,164,216 | A | 1/1965 | Hall, Sr. et al. | |
| 3,179,180 | A * | 4/1965 | Hart | E21B 17/06 166/216 |

(Continued)

FOREIGN PATENT DOCUMENTS

| | | | | |
|---|---|---|---|---|
| CA | 2760931 | A1 | 6/2013 | |
| CA | WO 2014121377 | A1 * | 8/2014 | E21B 17/07 |

(Continued)

OTHER PUBLICATIONS

PCT International Search Report dated Jan. 23, 2015; PCT/US2014/62775, filed Oct. 29, 2014; 1 page.

(Continued)

*Primary Examiner* — Jennifer H Gay
(74) *Attorney, Agent, or Firm* — Charles D. Gunter, Jr

(57) ABSTRACT

The lower end assembly of a measurement while drilling tool is secured against shock and vibration while drilling through the use of a locking cuff, an abrasion ring and a locking nut. A mule shoe at a lower end of the assembly has a diameter sized to allow a pulser helix to pass. The locking cuff is installed on one end of the mule shoe. A poppet housing is attached to an end of the pulser helix opposite the mule shoe. An abrasion ring is received about the external diameter of the pulser helix and is received on a shoulder located between the pulser helix and the poppet housing. An externally threaded lower end of the locking nut is received within a mating threaded bore in the extended locking cuff so that a portion of the locking nut is located between the locking cuff and the poppet housing. Tightening the locking nut within the bore of the locking cuff acts to lock the lower end assembly with respect to the mule shoe.

15 Claims, 7 Drawing Sheets

(56) References Cited

U.S. PATENT DOCUMENTS

| | | | | |
|---|---|---|---|---|
| 3,916,998 | A | 11/1975 | Bass, Jr. et al. | |
| 4,275,935 | A | 6/1981 | Thompson et al. | |
| 5,061,849 | A | 10/1991 | Meisner et al. | |
| 5,083,623 | A | 1/1992 | Barrington | |
| 5,317,111 | A | 5/1994 | Orban et al. | |
| 5,363,931 | A | 11/1994 | Moriarty | |
| 5,810,100 | A | 9/1998 | Samford | |
| 6,019,182 | A * | 2/2000 | Rountree | E21B 4/02 166/117.6 |
| 6,050,349 | A * | 4/2000 | Rountree | E21B 4/02 175/40 |
| 7,497,254 | B2 * | 3/2009 | Hall | E21B 47/01 166/242.6 |
| 7,690,425 | B2 * | 4/2010 | Giacomino | E21B 47/01 166/105 |
| 8,181,722 | B2 | 5/2012 | Radford et al. | |
| 8,474,548 | B1 * | 7/2013 | Young | E21B 47/187 175/40 |
| 8,534,381 | B1 * | 9/2013 | Rinald | E21B 47/187 175/40 |
| 2005/0178543 | A1 * | 8/2005 | Giacomino | E21B 47/01 166/250.01 |
| 2008/0230277 | A1 * | 9/2008 | Hall | E21B 47/01 175/325.1 |
| 2011/0120772 | A1 | 5/2011 | McLoughlin et al. | |
| 2011/0186284 | A1 | 8/2011 | Jekielek | |
| 2012/0247832 | A1 * | 10/2012 | Cramer | E21B 47/011 175/40 |
| 2013/0011102 | A1 * | 1/2013 | Rinzler | G02B 6/4296 385/89 |
| 2015/0129307 | A1 * | 5/2015 | Pope | E21B 47/01 175/40 |
| 2015/0159719 | A1 * | 6/2015 | Russell | E21B 17/07 267/141 |
| 2015/0300098 | A1 * | 10/2015 | Logan | E21B 47/01 166/237 |
| 2015/0322739 | A1 * | 11/2015 | Macdonald | E21B 47/01 166/378 |

FOREIGN PATENT DOCUMENTS

| | | | | |
|---|---|---|---|---|
| CN | WO 2015100845 | A1 * | 7/2015 | E21B 47/011 |
| EP | 164950 | A1 | 12/1985 | |
| WO | 2013/040641 | A1 | 3/2013 | |
| WO | WO 2015077339 | A2 * | 5/2015 | E21B 47/0002 |

OTHER PUBLICATIONS

M. Borghi et al.; "New Logging While Drilling Azimuthal Resistivity and High Resolution Imaging in Slim Holes"; symposium—10th Offshore Mediterranean Conference and Exhibition; pp. 1-9; Ravenna, Italy; Mar. 23-25, 2011.

* cited by examiner

METHOD AND APPARATUS FOR PROTECTING DOWNHOLE COMPONENTS FROM SHOCK AND VIBRATION

CROSS REFERENCE TO RELATED APPLICATIONS

The present application is a continuation-in-part of earlier filed Ser. No. 14/078,003, filed Nov. 12, 2013, entitled "Method and Apparatus for Protecting Downhole Components From Shock and Vibration", by the same inventor.

BACKGROUND OF THE INVENTION

1. Field of the Invention

The present invention relates generally to protecting downhole components from shock and vibration while drilling a well and, in particular, to a method and apparatus for protecting measurement while drilling equipment from shock and vibration using a locking mule shoe system.

2. Description of the Prior Art

In the drilling of deep bore holes for the exploration and extraction of crude oil and natural gas, the "rotary" drilling technique has become a commonly accepted practice. This technique involves using a drill string, which consists of numerous sections of hollow pipe connected together with a drill bit being located at the bottom end. The rotation and compression of the drilling bit causes the formation being drilled to be successively crushed and pulverized. Drilling fluid, frequently referred to as "mud", is pumped down the hollow center of the drill string, through nozzles on the drilling bit and then back to the surface around the annulus of the drill string. This fluid circulation is used to transport the cuttings from the bottom of the bore hole to the surface where they are filtered out and the drilling fluid is re-circulated as desired. The flow of the drilling fluid, in addition to removing cuttings, provides other secondary functions such as cooling and lubricating the drilling bit cutting surfaces and exerts a hydrostatic pressure against the bore hole walls to help contain any entrapped gases that are encountered during the drilling process.

Since the advent of drilling bore holes, the need to measure certain parameters at the bottom of the bore hole and provide this information to the driller has been recognized. These parameters include, for example, the temperature and pressure at the bottom of a bore well, the inclination or angle of the bore well, the direction or azimuth of the bore well, and various geophysical parameters that are of interest and value during the drilling process. The challenge of measuring these parameters in the hostile environment at the bottom of the bore well during the drilling process and somehow conveying this information to the surface in a timely fashion has led to the development of many devices and practices over the years.

The general class of tools used today to send data from the bottom of the well to the surface while drilling are referred to as "measurement while drilling" (hereafter "MWD" tools). Types of MWD tools contemplated by the prior art have been such things as electromagnetic waves or EM (low frequency radio waves or signals, currents in the earth or magnetic fields), acoustic (akin to sonar through the mud or pipe and using mechanical vibrations) and pressure or mud pulse (sending pulses through the mud stream using a valve mechanism).

Downhole tools of the above type are subjected to substantial forces and vibration during drilling. Sensor packages and other sensitive downhole electronics, such as those housed in measurement-while-drilling (MWD) tools, steering tools, gyros, or logging-while-drilling (LWD) tools, are particularly vulnerable to damage from vibration and shock during drilling. Unless the electronics in downhole tools are mounted in such a way as to reduce the vibration and shock that is felt by the electronics, the vibration and shock will ultimately reduce the life cycle of the electronics, as well as adding fatigue and wear to the bottom hole assembly. Reducing shock and vibration felt by the electronics extends their life cycle, which saves valuable time and money that would be spent replacing or repairing the directional sensors and electronics. Accordingly, additional measures to minimize shock and vibration that reaches electronics are needed.

One common feature of MWD tools of the type under consideration is to provide a mechanism for orienting the tool downhole. In order to ascertain the angular orientation of a drill bit, or the like, it is common practice in the art to dispose a radially inwardly extending camming member within a bore extending through the tool string. The camming member may be a key, a spline surface, or the like. The camming member is usually in a predetermined angular orientation with respect to the drill bit or member whose orientation it is desired to ascertain. For example, the "lower end assembly" of such tools often terminate at the bottom end in a "mule shoe" arrangement. The mule shoe internal bore receives what is called a pulser helix which is, in turn, attached to a poppet housing. The pulser helix has an axially extending camming surface which contacts the camming member inside the mule shoe as the pulser helix is inserted within the bore of the mule shoe. Abutting engagement of the camming surface and camming member acts to rotate the directional drilling assembly. When the camming surface and camming member are fully engaged, the directional ascertaining element of the assembly may accurately plot or record the orientation at which the camming member, and therefore the drill bit, are disposed relative to a predetermined datum.

Even though the pulser helix may be affixed to the mule shoe with a key arrangement or the like, some movement and vibration are still possible. For example, some oil and gas exploration and production companies at the present time use vibrating devices known as "agitators" to increase penetration rates while drilling wells. Agitators typically operate or reciprocate between about 12 and 26 hertz during drilling operations, and constantly vibrate at these frequencies. Accordingly, agitators provide additional shock and vibration throughout the drill string that improve drilling performance. However, these devices can cause damage to or the failure of the sensitive downhole components used in the MWD systems. Such sensitive electronic components of the MWD systems may be subjected to g-force vibration and shock on the order of 100 g's in amplitude.

Thus, despite improvements that have been made in MWD systems, a need continues to exist for a method and improved apparatus for further reducing shock and vibration in such devices in use.

SUMMARY OF THE INVENTION

The invention described herein deals with improvements in the "lower end assembly" of a measurement while drilling (MWD) tool, where the lower end assembly includes a mule shoe with an interior which receives a pulser helix, the pulser helix being attached to a poppet housing at an end opposite the mule shoe. These are all traditional components of such lower end assemblies. However, the improved lower end of the invention incorporates a novel arrangement of an extended locking cuff, an abrasion ring and a locking nut. The addition of these new components results in a lower end assembly which is more completely secured and thus more completely protected from the effects of shock and vibration during drilling than were the prior art assemblies.

The extended locking cuff which is used in the improved assembly has a first externally threaded extent which is received within a mating internally threaded bore at one extent of the mule shoe. The extended locking cuff also has a threaded internal diameter which is sized to allow the passage of the pulser helix when the pulser helix is passed through the locking cuff into the interior of the mule shoe.

The abrasion ring is received about the external diameter of the pulser helix. The abrasion ring is received on a shoulder located between the pulser helix and the poppet housing. The poppet housing has a lower threaded extent which engages a mating threaded extent of the upper end of the pulser helix to retain the abrasion ring in position on the shoulder.

The locking nut has an internal bore which is sized to be received over the external diameter of the poppet housing. The locking nut also has an externally threaded lower extent which is sized to be received within a mating threaded bore in the extended locking cuff so that a portion of the locking nut is located between the locking cuff and the poppet housing. Tightening the locking nut within the bore of the locking cuff serves to lock the lower end assembly with respect to the mule shoe.

Preferably, the locking nut has a tool receiving end located opposite the externally threaded lower end, the tool receiving end terminating in a collet-like profile. The collet-like profile preferably comprises a series of alternating tongues and slots. A hand wrench can conveniently be used to turn the locking nut to engage the extended locking cuff by providing the wrench with a wrench end which engages selected ones of the tongues and slots so that turning the wrench end turns the locking nut.

A method is also shown for protecting sensitive components contained in a lower end assembly of a measurement while drilling too while drilling where the measurement while drilling tool is attached to a drill bit at one end and to an electronics package at an opposite end. As previously described, the lower end assembly is provided with a mule shoe with an interior which receives a pulser helix, the pulser helix having a threaded upper extent, an external diameter and an external orienting surface located on the external diameter for contacting a mating orienting surface within the mule shoe interior. The pulser helix is attached to a poppet housing at an end opposite the mule shoe, the poppet housing having an external diameter, a threaded upper extent and a threaded lower extent. The poppet housing can be attached at the upper extent thereof to a screen housing.

In the assembly method of the invention, the lower end assembly is provided with a series of new components including the extended locking cuff, abrasion ring and lock nut, previously described, which secure the components of the lower end assembly in place during drilling, the new components being assembled as follows:

installing the extended locking cuff on an upper end of the mule shoe, the locking cuff having a first externally threaded extent which is received within a mating internally threaded bore of the mule shoe, the extended locking cuff also having a threaded internal diameter which is sized to allow the passage of the pulser helix when the pulser helix is passed through the locking cuff into the interior of the mule shoe;

installing the abrasion ring about the external diameter of the pulser helix, the abrasion ring being received on a shoulder located between the pulser helix and the poppet housing, the poppet housing having a lower threaded extent which is engaged with a mating threaded extent of the upper end of the pulser helix to retain the abrasion ring in position on the shoulder;

inserting the pulser helix into the interior of the mule shoe and locking it in place with a mule shoe key;

wherein the locking nut is provided with an internal bore which is sized to be received over the external diameter of the poppet housing, the locking nut also having an externally threaded lower extent which is sized to be received within a mating threaded bore in the extended locking cuff;

sliding the locking nut over the poppet housing into engagement with the extended wear cuff, so that a portion of the locking nut is located between the locking cuff and the poppet housing;

tightening the locking nut within the bore of the locking cuff, whereby the tightening action serves to lock the lower end assembly with respect to the mule shoe.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

The drawings and the description below disclose specific embodiments with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results. The terminology used in the discussion which follows will be taken to have the meaning generally accepted in common usage, or with respect to the oil and gas industry, unless otherwise indicated. Thus, for example, in the discussion which follows, the terms "upper" or "uphole" means towards the surface (i.e. shallower) in a wellbore, while "lower" or "downhole" means away from the surface (i.e. deeper) in the wellbore. The terms "mule shoe", "pulser helix", "poppet housing" and "screen housing" will be familiar to those skilled in the relevant art and will have the commonly accepted meaning as used in the measurement while drilling industry.

Figure 1:
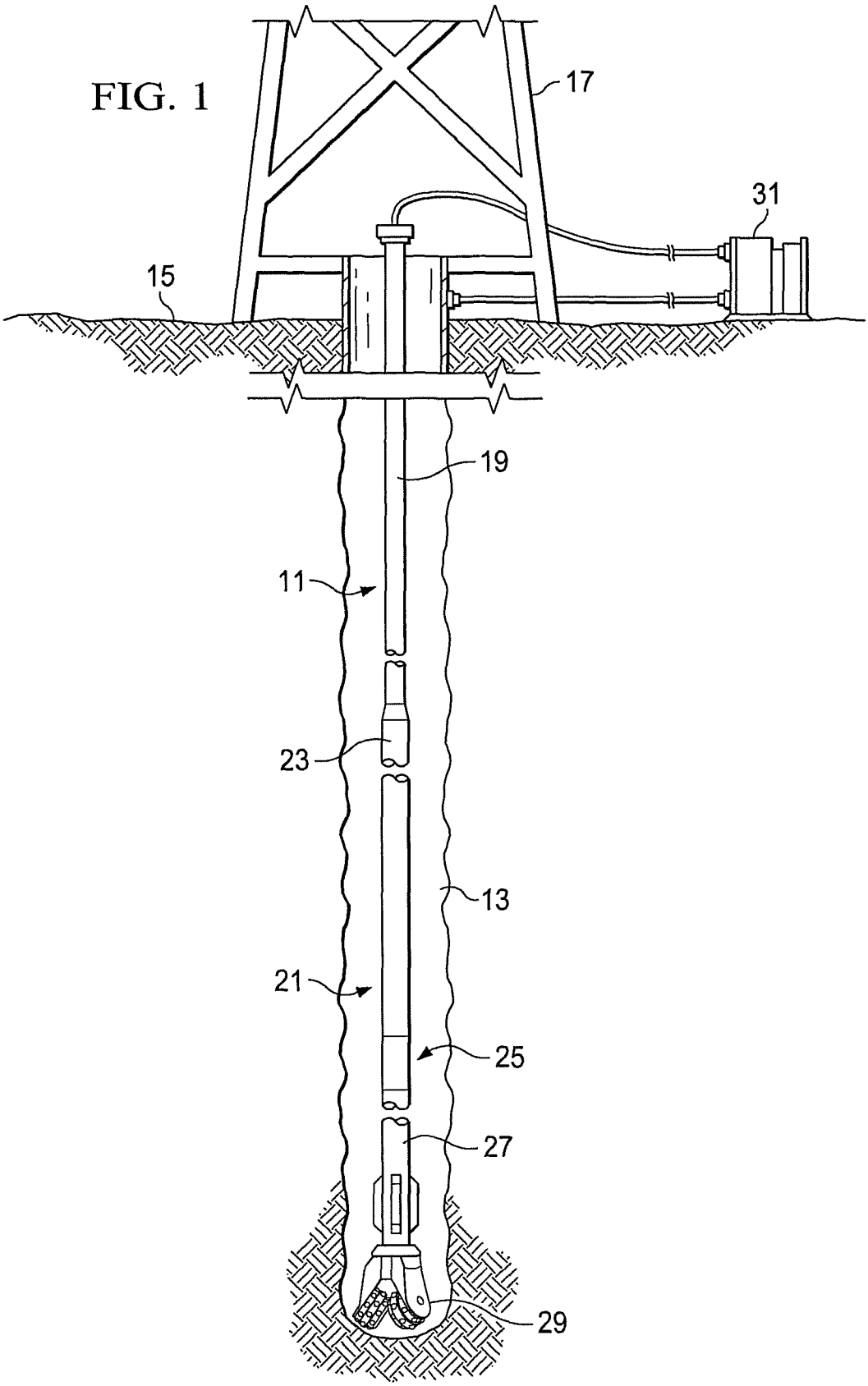
FIG. 1 is a simplified view of an oil/gas well being drilled with a drill string which includes a downhole measurement while drilling apparatus which incorporates the shock and vibration reducing features of the invention.

Referring now to FIG. 1, a drill string 11 is suspended in a wellbore 13 and supported at the surface 15 by a drilling rig 17. The drill string 11 includes a drill pipe 19 coupled to a downhole tool assembly 21. The downhole tool assembly 21 includes multiple drill collars 23, a measurement-while-drilling (MWD) tool assembly which terminates in a UBHO sub 25, a mud motor 27, and a drill bit 29. In the arrangement illustrated, the drill collars 23 are connected to the drill string 11 on the uphole end of the drill collars 23. Similarly, the uphole end of the MWD tool assembly is connected to the downhole end of the drill collars 23, or vice versa. The uphole end of the mud motor 27 is connected to the downhole end of MWD tool assembly. The downhole end of the mud motor 27 is connected to drill bit 29.

The drill bit 29 is rotated by rotary equipment on the drilling rig 17 and/or the mud motor 27 which responds to the flow of drilling fluid, or mud, which is pumped from a mud tank 31 through a central passageway of the drill pipe 19, drill collars 23, MWD tool assembly 25 and then to the mud motor 27. The pumped drilling fluid jets out of the drill bit 29 and flows back to the surface through an annular region between the drill string 11 and the wellbore 13. The drilling fluid carries debris away from the drill bit 29 as the drilling fluid flows back to the surface. Shakers and other filters remove the debris from the drilling fluid before the drilling fluid is recirculated downhole.

The drill collars 23 provide a means to set weight off on the drill bit 29, enabling the drill bit 29 to crush and cut the formations as the mud motor 27 rotates the drill bit 29. As drilling progresses, there is a need to monitor various downhole conditions. To accomplish this, the MWD tool assembly 25 measures and stores downhole parameters and formation characteristics for transmission to the surface. This may be accomplished, for example, by using the circulating column of drilling fluid. In one known technique, the downhole information is transmitted to the surface via encoded pressure pulses in the circulating column of drilling fluid. There are other known techniques for transmitting the data, as well, that will be familiar to those skilled in the relevant arts.

Figure 2:
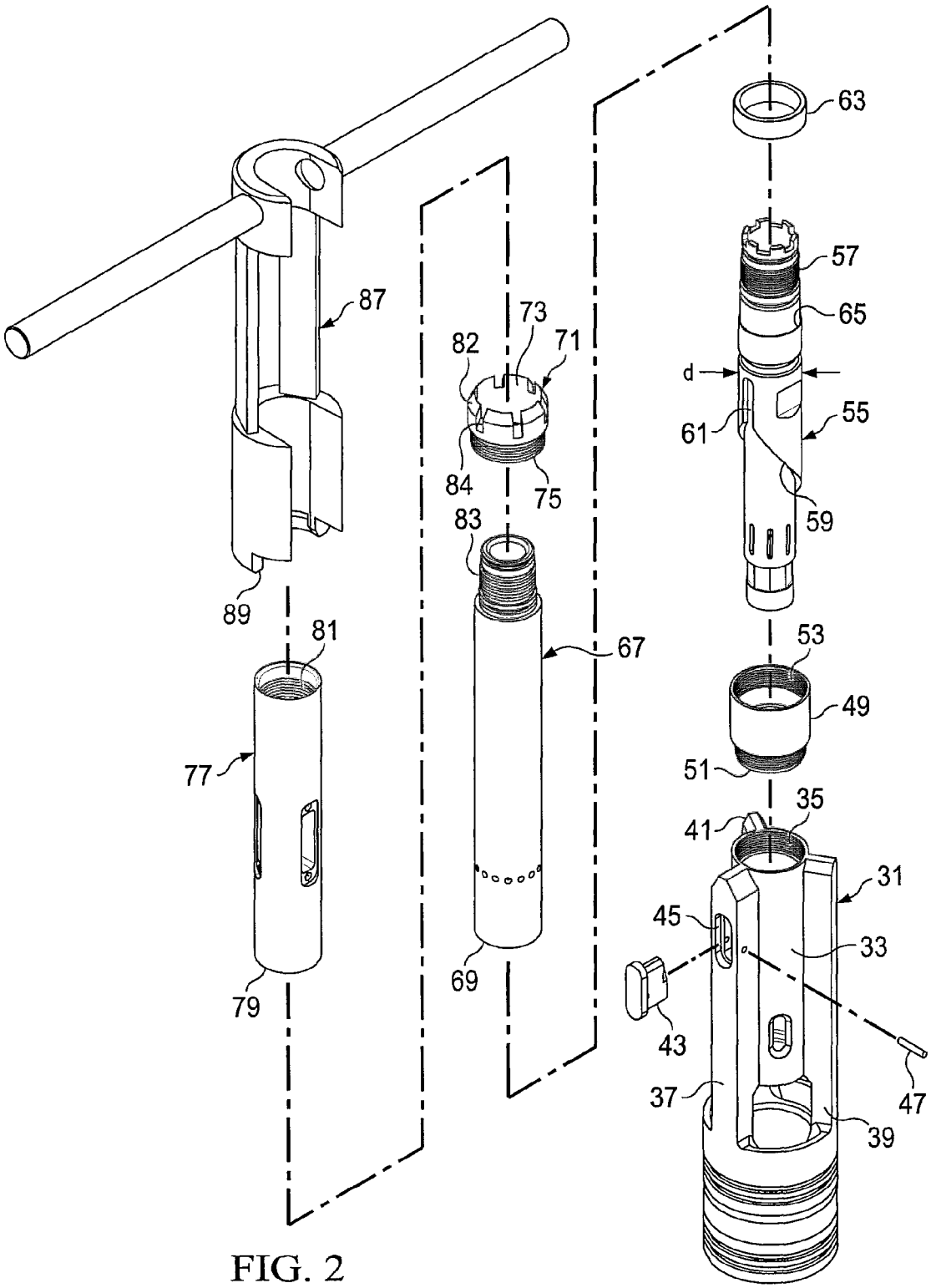
FIG. 2 is an exploded view of a lower end assembly of the measurement while drilling tool which incorporates the features of the invention.

FIG. 2 shows the "lower end assembly" of the MWD tool of the invention in exploded fashion, for ease of illustration. Certain of the components of the MWD assembly shown in FIG. 2 are conventional in the industry and will be familiar to those skilled in the art. The lowermost extent of the assembly includes a mule shoe 31. The MWD assembly is typically oriented and fixed within a section of drill collar using the universal bore hole orientation mule shoe 31 (commonly known as a "UBHO sub"). The UBHO or mule shoe sub 31 axially and rotationally fixes the downhole electronics package within the drill collar, as will be more fully described in the discussion which follows. The mule shoe 31 has a tubular interior portion 33 with an interior, including an internally threaded bore 35 at one extent thereof. A series of spline-like longitudinal projections 37, 39, 41 run longitudinally down the tubular interior portion at equi-angular spaced locations. A key 43 is receivable within a keyhole 45 where it can be locked in place by a pin 47.

An extended locking cuff 49 has a first internally threaded extent 51 which is sized to be received within the mating internally threaded bore 35 of the upper extent of the mule shoe. The extended locking cuff 49 also has a threaded internal diameter 53 which is sized to allow the passage of a pulser helix 55 when the pulser helix is passed through the locking cuff into the interior of the mule shoe during an orienting operation, as will be explained more fully in the discussion which follows.

The pulser helix is a standard component in MWD assemblies as is commercially available, for example, from Hunting Specialty Supply, 13730 Cypress North Houston Road, Cypress, Tex. 77429. The pulser helix has a threaded upper extent 57, an external diameter, the maximum extent of which is illustrated as "d" in FIG. 2, and an external orienting surface located on the external diameter. In the case of the particular tool illustrated in FIG. 2, the orienting surface is a tapered sleeve-like region having a camming surface 59 which terminates in a slot 61. The orienting surface is designed to contact a mating orienting surface (not shown) in the mule shoe, in known fashion. The mating surface might be, for example, a tab which protrudes part way into the bore of the tubular interior portion 33 of the mule shoe 31.

Figure 5:
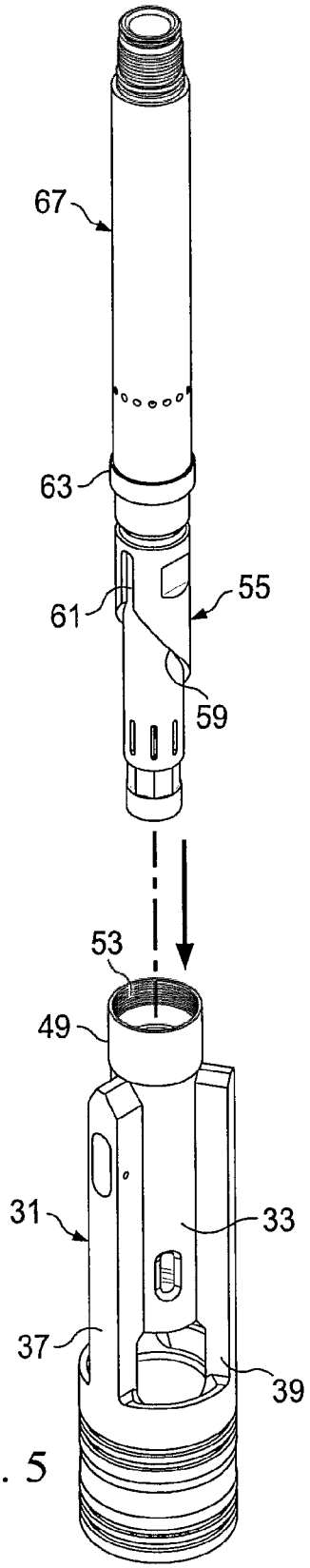
Figure 6:
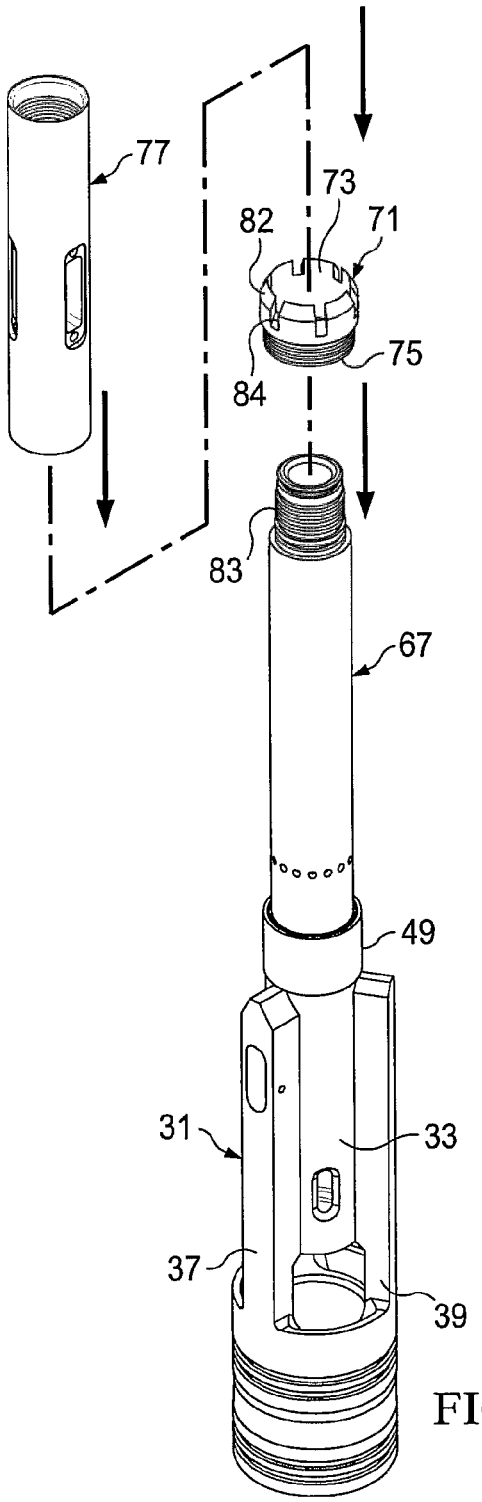
Figure 7:
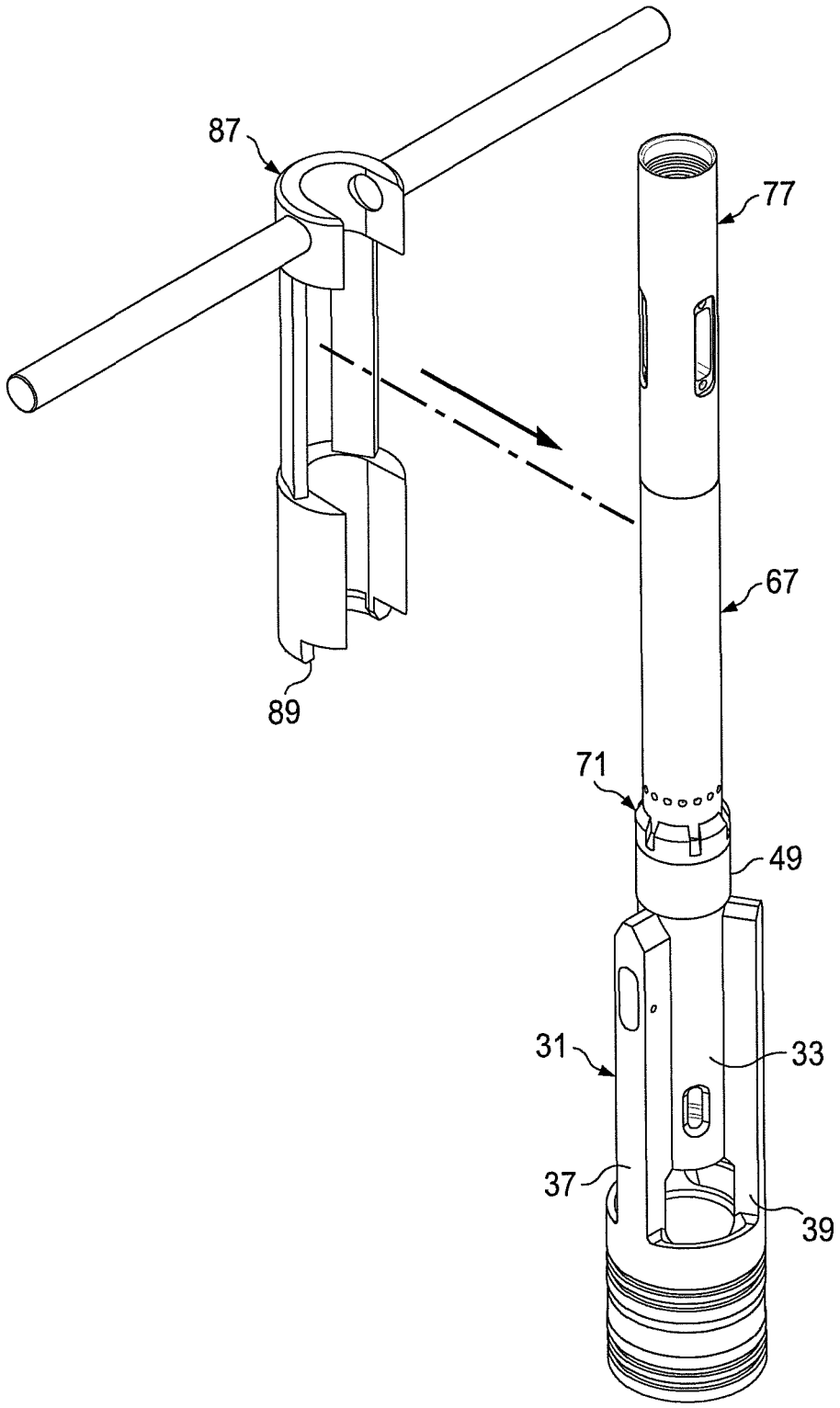
Figure 8:
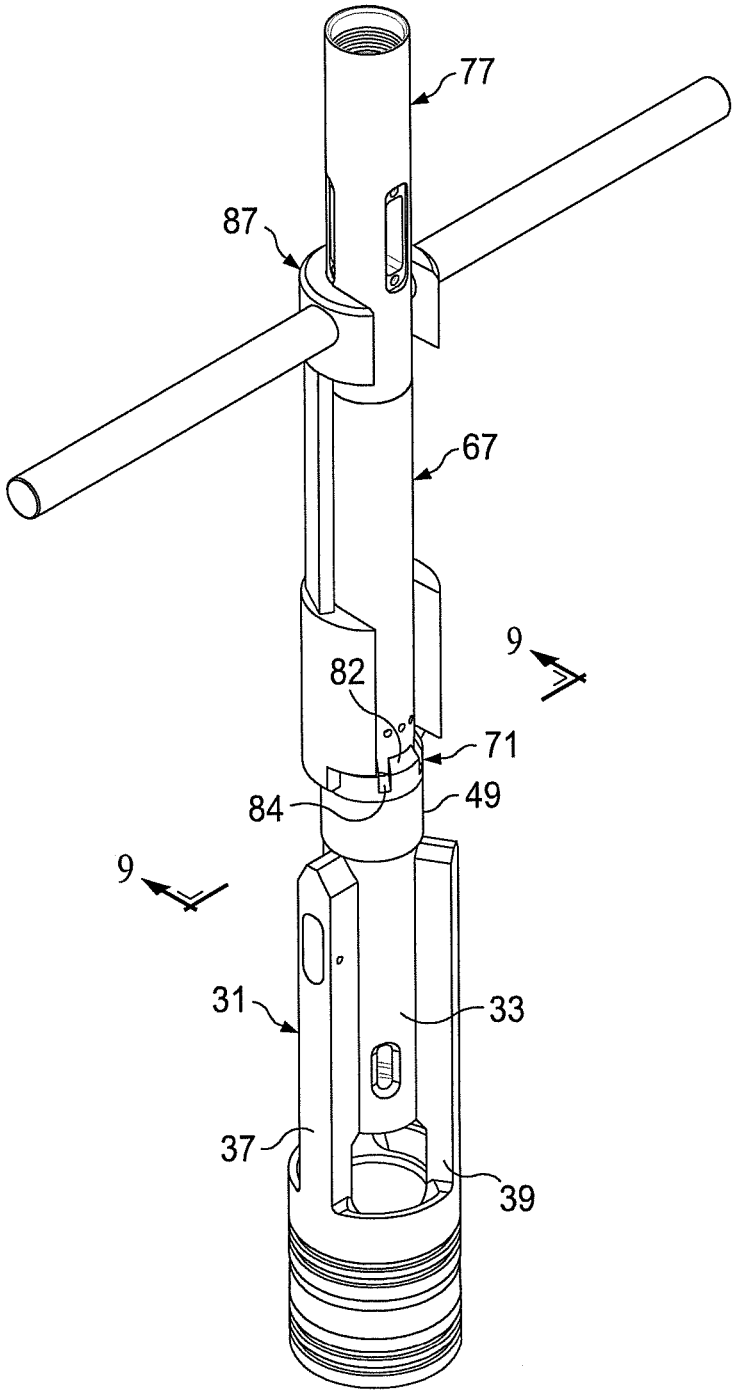

An abrasion ring 63 is received about the external diameter of the pulser helix 55 and is received on a shoulder 65 located between the pulser helix and a poppet housing 67, The poppet housing 67 has a lower internally threaded extent 69 which engages the mating threaded upper extent 57 of the upper end of the pulser helix 55 to retain the abrasion ring 63 in position on the shoulder 65. FIG. 5 shows the abrasion ring 63 received on the external shoulder which is located on the external diameter of the pulser helix 55.

Figure 9:
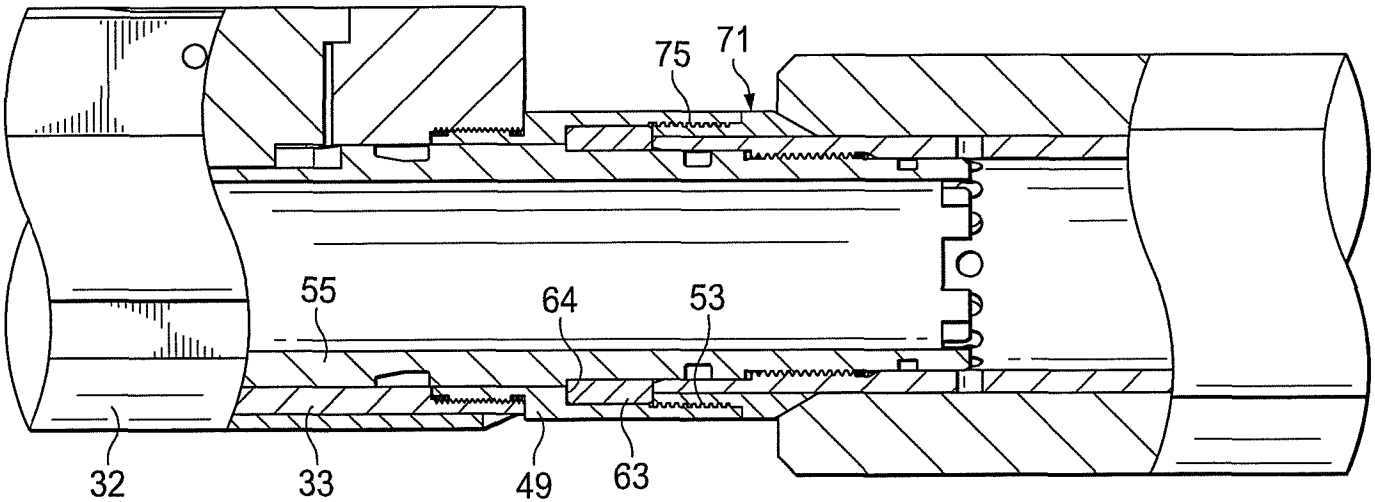
FIG. 9 is a partial sectional view of the components of the lower assembly taken generally along lines IX-IX in FIG. 8.

A locking nut 71 has an internal bore 73 which is sized to be received over the external diameter of the poppet housing 67. The locking nut 71 also has an externally threaded lower extent 75 which is sized to be received within the mating threaded bore 53 in the extended locking cuff 49, so that a portion of the locking nut is located between the locking cuff and the poppet housing. The position of the locking nut 71 relative to the extended locking cuff 49 can perhaps best be seen in the cross-sectional view of FIG. 9. This view shows the mule shoe 31 located within a surrounding mule shoe sleeve 32. This view also shows the abrasion ring 63 resting on an internal shoulder within the internal diameter of the locking cuff 49. As will be explained more fully, tightening the locking nut 71 within the internally threaded bore 53 of the locking cuff 49 serves to lock the lower end assembly with respect to the mule shoe.

FIG. 2 also shows a conventional screen housing 77 having oppositely arranged internally threaded bores 79 and 81. The threaded bore 79 engages a mating externally threaded end 83 of the poppet housing when the assembly is completed.

It will be appreciated from FIG. 2 that the locking nut 71 terminates at one end in a tool-receiving end comprising a collet-like profile made up of alternating tongues 82 and slots 84. A hand tool, namely wrench 87 has an end with a profile 89 which is designed to engage and mate with selected ones of the tongues 82 and slots 84 of the locking nut 71, whereby turning the wrench 87 screws the locking nut 71 down into the position shown in FIG. 9 with respect to the locking cuff 49.

Figure 3:
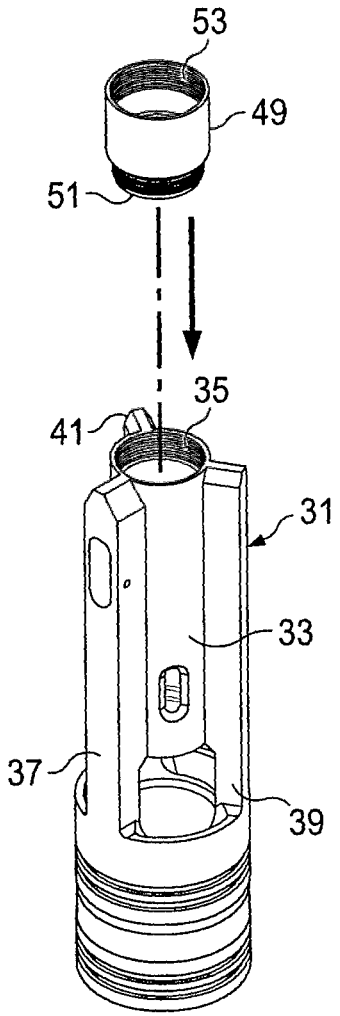
FIG. 3-8 illustrate the various steps involved in assembling the improved lower end assembly, the lower end assembly including the improved shock and vibration reducing components of the invention.
Figure 4:
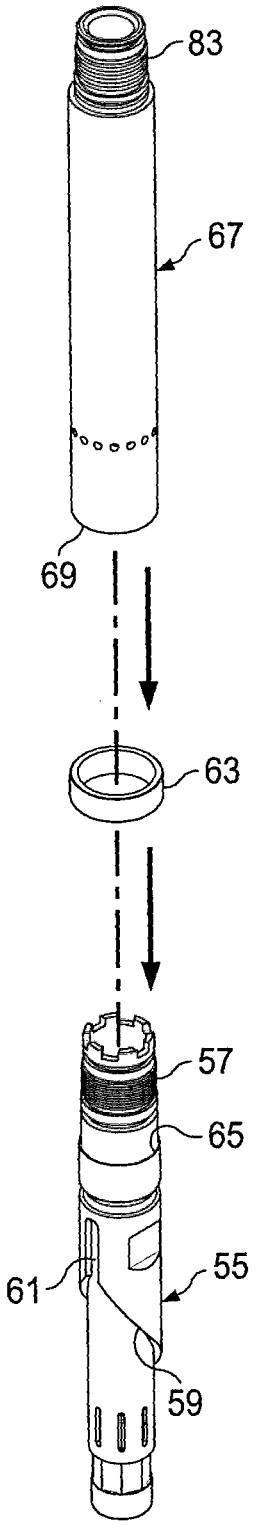

FIGS. 3-8 illustrate the steps involved in the assembly of the lower end using the component parts previously described. In FIG. 3, the extended wear cuff 49 is first screwed into the internally threaded bore 35 of the pulser helix 31. The abrasion ring 63 slides over the external diameter of the pulser helix 55 and comes to rest on the external shoulder 65. The lower internally threaded extent 69 of the poppet housing 67 is then threaded onto the threaded upper extent 57 of the pulser helix 55 to lock the abrasion ring into position.

FIG. 5 shows the abrasion ring 63 locked into position on the pulser helix 55. In the next step in the operation, the pulser helix assembly is inserted into the bore 35 of the mule shoe 31. The bore 35 is sufficiently large as to allow the pulser helix and the abrasion ring 63 to pass within the bore, so that the abrasion ring comes to rest on a shoulder (64 in FIG. 9) provided within the internal diameter of the locking cuff 49. The locking nut 71 is then slid over the external diameter of the poppet housing 67 until the externally threaded lower extent 75 contacts the threaded internal diameter 53 of the locking cuff 49. The screen housing 77 can also be engaged with the externally threaded end 83 of the poppet housing 67.

At this point, the locking wrench (87 in FIG. 7) can be moved in a lateral direction toward the lower end assembly so that the wrench end profile 89 engages selected ones of the tongues and slots 82, 84 on the locking nut 71 upper extent, whereby turning the wrench 87 by hand tightens the locking nut 71. The final position of the locking nut can perhaps best be seen in FIG. 9. This action serves to lock the lower end assembly with respect to the mule shoe.

An invention has been provided with several advantages. The assembled lower end assembly includes new components which lock the lower end to the mule shoe in a more positive fashion than was done in the past. The result is that less shock is transmitted to the downhole electronics package from the drill string. The newly added component package works with existing pulser helix and mule shoe sleeves. The improved assembly drastically reduces axial and lateral vibration. The assembly solves a number of problems related to the lower end assembly unseating, especially while using an agitator. The component parts are relatively simple in design and economical to manufacture so that the improved assembly involves minimal implementation cost. In actual tests, the system without the improvements of the invention revealed that the downhole memory module of the system showed extreme amounts of axial shock and vibration. Axial shock reached levels about 120 g's and axial vibration exceeded 30 gRMS. With the improved assembly of the invention installed on the lower end, the amount of axial shock and vibration was reduced to under 20 g's of axial shock and axial vibration. Even after a 60 hour run, there was minimal wash observed on the lock nut collet (crown) profile and threads.

The embodiment of the lower end assembly shown in FIGS. 1-9 provides a relatively simple and low maintenance way to reduce the shock and vibration experienced by downhole electronics packages. By virtue of incorporating the widely accepted UBHO sub, the improved lower end is easily added to existing drill string designs. Assembly of the various interior components can be carried out in a series from end to end and then placed fully assembled into the drill collar. After placement into the drill collar, the drilling personnel need only to make-up the well-known threaded connections to the drill string where they would normally place the drill collar for the downhole electronics package. Determining the orientation of the downhole electronics package can be carried out as normal.

While the invention has been shown in only one of its forms, it is not thus limited but is susceptible to various changes and modifications without departing from the spirit thereof. Thus, those having ordinary skill in the art will appreciate that various individual components described above as being separate may be combined according to design preferences without departing from the scope of the present disclosure. Further, various components with multiple design features that are combined may be separated into discrete components. Other variations will be apparent to those skilled in the relevant arts. The foregoing drawings and description disclose a specific embodiment of the invention with the understanding that the embodiment is considered an exemplification of the principles of the invention, and are not intended to limit the invention to what is specifically illustrated and described.

What is claimed is:

1. In a lower end assembly for a measurement while drilling tool, the lower end assembly including a mule shoe with an interior which receives a pulser helix, the pulser helix being attached to a poppet housing at an end opposite the mule shoe, the improvement comprising:

an extended locking cuff having a first externally threaded extent which is received within a mating internally threaded bore at one extent of the mule shoe, the extended locking cuff also having a threaded internal diameter which is sized to allow the passage of the pulser helix when the piker helix is passed through the locking cuff into the interior of the mule shoe;

an abrasion ring received about the external diameter of the pulser helix, the abrasion ring being received on a shoulder located between the pulser helix and the poppet housing, the poppet housing having a lower threaded extent which engages a mating threaded extent of the upper end of the pulser helix to retain the abrasion ring in position on the shoulder;

a locking nut having an internal bore which is sized to be received over the external diameter of the poppet housing, the locking nut also having an externally threaded lower extent which is sized to be received within a mating threaded bore in the extended locking cuff so that a portion of the locking nut is located between the locking cuff and the poppet housing, tightening the locking nut within the bore of the locking cuff serving to lock the lower end assembly with respect to the mule shoe.

2. The lower end assembly of claim 1, wherein the locking nut has a tool receiving end located opposite the externally threaded lower end, the tool receiving end terminating in a collet profile.

3. The lower end assembly of claim 1, wherein the abrasion ring is located between an external surface of the pulser helix and an internal surface of the extended locking cuff when the assembly is completed.

4. The lower end assembly of claim 1, wherein the pulses helix is locked to the mule shoe by a key inserted within a keyway provided in the mule shoe once the pulser helix has been positioned within the mule shoe.

5. The lower end assembly of claim 2, wherein the collet profile comprises a series of alternating tongues and grooves.

6. In a lower end assembly for a measurement while drilling tool which assembly is attached to a drill bit at one end and to an electronics package at an opposite end, the lower end assembly including a mule shoe with an interior which receives a pulser helix, the pulser helix having a threaded upper extent, an external diameter and an external orienting surface located on the external diameter for contacting a mating orienting surface within the mule shoe interior, the pulser helix being attached to a poppet housing at an end opposite the mule shoe, the poppet housing having an external diameter, a threaded upper extent and a threaded lower extent, the poppet housing being attached at the upper extent thereof to a screen housing, the improvement comprising:

an extended locking cuff having a first externally threaded extent which is received within a mating internally threaded bore at one extent of the mule shoe, the extended locking cuff also having a threaded internal diameter which is sized to allow the passage of the pulser helix when the pulser helix is passed through the locking cuff into the interior of the mule shoe, contact between the orienting surfaces on the external diameter of the pulser helix with the mating orienting surface within the mule shoe interior serving to orient the pulser helix with respect to the mule shoe when the pulser helix is installed within the mule shoe;

an abrasion ring received about the external diameter of the pulser helix, the abrasion ring being received on a shoulder located between the pulser helix and the poppet housing, the poppet housing having a lower threaded extent which engages a mating threaded extent of the upper end of the pulser helix to retain the abrasion ring in position on the shoulder;

a locking nut having an internal bore which is sized to be received over the external diameter of the poppet housing, the locking nut also having an externally threaded lower extent which is sized to be received within a mating threaded bore in the extended locking cuff so that a portion of the locking nut is located between the locking cuff and the poppet housing, tightening the locking nut within the bore of the locking cuff serving to lock the lower end assembly with respect to the mule shoe.

7. The lower end assembly of claim 6, wherein the locking nut has a tool receiving end located opposite the externally threaded lower end, the tool receiving end terminating in a collet profile.

8. The lower end assembly of claim 6, wherein the abrasion ring is located between an external surface of the pulser helix and an internal surface of the extended locking cuff when the assembly is completed.

9. The lower end assembly of claim 6, wherein the pulser helix is locked to the mule shoe by a key inserted within a keyway provided in the mule shoe once the pulser helix has been positioned within the mule shoe.

10. The lower end assembly of claim 7, wherein the collet profile comprises a series of alternating tongues and grooves.

11. A method for protecting sensitive components contained in a lower end assembly of a measurement while drilling too while drilling where the measurement while drilling tool is attached to a drill bit at one end and to an electronics package at an opposite end, where the lower end assembly is provided with a mule shoe with an interior which receives a pulser helix, the pulser helix having a threaded upper extent, an external diameter and an external orienting surface located on the external diameter for contacting a mating orienting surface within the mule shoe interior, the pulser helix being attached to a poppet housing at an end opposite the mule shoe, the poppet housing having an external diameter, a threaded upper extent and a threaded lower extent, the poppet housing being attached at the upper extent thereof to a screen housing, the method comprising the steps of:

providing the lower end assembly with a series of new components including an extended locking cuff, abrasion ring and lock nut which secure the components of the lower end assembly in place during drilling, the new components being assembled as follows:

installing the extended locking cuff on an upper end of the mule shoe, the locking cuff having a first externally threaded extent which is received within a mating internally threaded bore of the mule shoe, the extended locking cuff also having a threaded internal diameter which is sized to allow the passage of the pulser helix when the pulser helix is passed through the locking cuff into the interior of the mule shoe;

installing the abrasion ring about the external diameter of the pulser helix, the abrasion ring being received on a shoulder located between the pulser helix and, the poppet housing, the poppet housing having a lower threaded extent which is engaged with a mating threaded extent of the upper end of the pulser helix to retain the abrasion ring in position on the shoulder;

inserting the pulser helix into the interior of the mule shoe and locking it in place with a mule shoe key;

wherein the locking nut is provided with an internal bore which is sized to be received over the external diameter of the poppet housing, the locking nut also having an externally threaded lower extent which is sized to be received within a mating threaded bore in the extended locking cuff;

sliding the locking nut over the poppet housing into engagement with the extended wear cuff, so that a portion of the locking nut is located between the locking cuff and the poppet housing;

tightening the locking nut within the bore of the locking cuff, whereby the tightening action serves to lock the lower end assembly with respect to the mule shoe.

12. The method of claim 11, wherein contact between the orienting surfaces on the external diameter of the pulser helix with the mating orienting surface within the mule shoe interior serve to orient the pulser helix with respect to the mule shoe when the pulser helix is installed within the mule shoe.

13. The method of claim 12, wherein the locking nut is provided with a tool receiving end located opposite the externally threaded lower end, the tool receiving end terminating in a collet profile.

14. The method of claim 13, the collet profile comprises a series of alternating tongues and grooves, and wherein a hand wrench is used to turn the locking nut to engage the extended locking cuff, the wrench having a wrench end which engages selected ones of the tongues and grooves so that turning the wrench end turns the locking nut.

15. The method of claim 14, wherein the abrasion ring is located between an external surface of the pulses helix and an internal surface of the extended locking cuff when the assembly is completed.

* * * * *